US008127928B2

(12) United States Patent
Stack, Jr. et al.

(10) Patent No.: US 8,127,928 B2
(45) Date of Patent: Mar. 6, 2012

(54) SUSPENSION PACKAGING

(76) Inventors: Steven Michael Stack, Jr., Watertown, CT (US); David Goodrich, Newton, CT (US)

( * ) Notice: Subject to any disclaimer, the term of this patent is extended or adjusted under 35 U.S.C. 154(b) by 91 days.

(21) Appl. No.: 12/570,755

(22) Filed: Sep. 30, 2009

(65) Prior Publication Data

US 2010/0078466 A1 Apr. 1, 2010

Related U.S. Application Data

(60) Provisional application No. 61/194,663, filed on Sep. 30, 2008.

(51) Int. Cl.
*B65D 81/07* (2006.01)
*B65D 81/05* (2006.01)

(52) U.S. Cl. ..... 206/583; 206/594; 206/591

(58) Field of Classification Search ..... 206/466, 206/521, 583, 591, 592, 594; 229/110, 120.38
See application file for complete search history.

(56) References Cited

U.S. PATENT DOCUMENTS 2,956,672 A 10/1960 Kirkpatrick
3,752,301 A 8/1973 Bluemel
4,194,678 A * 3/1980 Jasper ..... 206/433
4,470,538 A 9/1984 Heathcock et al.
4,757,900 A 7/1988 Misset et al.
4,852,743 A * 8/1989 Ridgeway ..... 206/583
4,923,065 A 5/1990 Ridgeway
5,071,009 A 12/1991 Ridgeway
5,086,925 A 2/1992 Coalier et al.
5,251,760 A 10/1993 Smith et al.
5,259,507 A 11/1993 Smith
5,287,968 A 2/1994 Ridgeway
5,388,701 A 2/1995 Ridgeway
5,454,642 A 10/1995 De Luca
5,573,119 A * 11/1996 Luray ..... 206/583
5,669,506 A 9/1997 Lofgren et al.
5,678,695 A 10/1997 Ridgeway et al.
5,722,541 A 3/1998 Lofgren et al.
5,762,200 A 6/1998 Goudreau
5,871,101 A 2/1999 Alden
5,893,462 A 4/1999 Ridgeway
5,894,932 A 4/1999 Harding et al.
5,901,852 A 5/1999 Simpson
5,967,327 A 10/1999 Jones
5,967,406 A * 10/1999 Moorman ..... 229/120.37
5,975,307 A 11/1999 Harding et al.
6,006,917 A * 12/1999 Loeffler ..... 206/583
6,010,006 A 1/2000 Ridgeway et al.
6,016,919 A 1/2000 Smith et al.
6,119,863 A 9/2000 Lofgren et al.
6,158,589 A 12/2000 Smith et al.
6,206,194 B1 3/2001 Beneroff et al.

(Continued)

*Primary Examiner* — David Fidei
(74) *Attorney, Agent, or Firm* — Sheldon H Parker Esq

(57) ABSTRACT

The present invention relates generally to a collapsible shipping container utilizing standard box making equipment manufactured from material such as paper, corrugated board, and corrugated plastic, and in particular, to a package that employs a tensioned film system, that holds a product hammock style, between two layers of film and/or between a film and a wall of the package. To use the box, the formed box which has been stored in a flat configuration, is unfolded to a substantially rectangular or square configuration by folding at least one flap panel about its fold line to a position superadjacent a central panel and conforming the container to a hexagonal cross-section. In this configuration the box retains its hexagonal cross-section and can be self supporting in a vertical position, in order to facilitate the filing operation.

15 Claims, 12 Drawing Sheets

U.S. PATENT DOCUMENTS

| | | | | |
|---|---|---|---|---|
| 6,216,871 | B1 | 4/2001 | Bacques et al. | |
| 6,223,901 | B1 | 5/2001 | Lofgren et al. | |
| 6,302,274 | B1 | 10/2001 | Ridgeway | |
| 6,308,828 | B1 * | 10/2001 | Jones | 206/223 |
| 6,311,843 | B1 * | 11/2001 | Smith et al. | 206/583 |
| 6,394,336 | B1 | 5/2002 | Beneroff et al. | |
| 6,398,098 | B1 | 6/2002 | Kada | |
| 6,467,624 | B1 | 10/2002 | Lofgren et al. | |
| 6,513,658 | B1 | 2/2003 | Adkins | |
| 6,675,973 | B1 | 1/2004 | McDonald | |
| 6,676,011 | B2 | 1/2004 | Luu et al. | |
| 6,899,229 | B2 | 5/2005 | Dennison et al. | |
| 6,920,981 | B2 | 7/2005 | Lofgren et al. | |
| 6,942,101 | B2 | 9/2005 | Lofgren et al. | |
| 7,086,534 | B2 | 8/2006 | Roesel et al. | |
| 7,150,356 | B2 | 12/2006 | Lofgren et al. | |
| 7,694,496 | B2 | 4/2010 | Keiger et al. | |
| 2006/0102515 | A1 | 5/2006 | McDonald et al. | |
| 2006/0113366 | A1 | 6/2006 | McKenna | |

* cited by examiner 100
101
102
103
104
105
105A
106
108
109
110
111
112
113
114
150
152
153
155
156
158
159
160
161
162
170
171
173
174
175
177
180
181
182
184
186
190
192
194
196
198

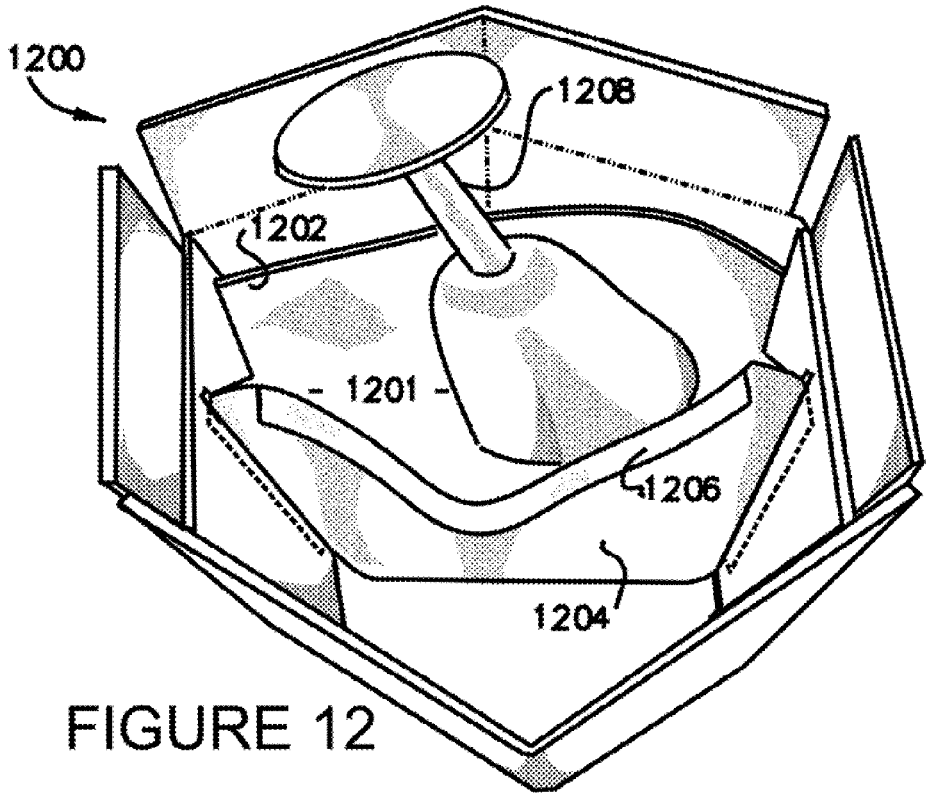
FIGURE 12
FIGURE 13
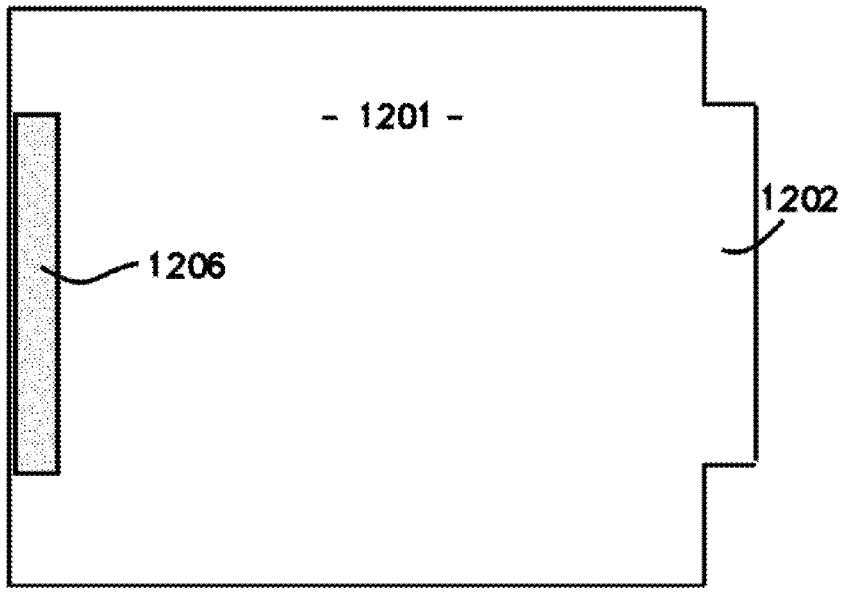

SUSPENSION PACKAGING

This patent application claims the benefit of provisional patent application 61/194,663, filed Sep. 30, 2008, and having the title "Suspension Packaging", the disclosure of which is incorporated by reference, as though recited in full.

BACKGROUND

1. Field of Invention

The present invention relates generally to a collapsible shipping container utilizing standard box making equipment manufactured from material such as paper, corrugated board, and corrugated plastic, and in particular, to a package that employs a tensioned film system, that holds a product hammock style, between two layers of film and/or between a film and a wall of the package.

2. Brief Description of Prior Art

The prior art includes numerous variations of boxes that employ a hammock like structure to cradle a product within the box. However, there is still a need to design a box that provides the combination of low cost, ease of manufacture, ease of transport to an end user, ease of use from the end user's standpoint, and which provides a required level of cushioning.

SUMMARY

The present invention relates to a typical box having four sides and bottom and top flaps when erected.

In accordance with an embodiment of the invention, a box comprises a first blank having a first center panel with four edges and four flap panels. Each of the four flap panels is contiguous with one of the center panel four edges and separated therefrom by a flap panel fold line. The center panel has a first central fold line extending parallel to the flap panel fold line separating the opposing first and third panels. The central fold line extends from an edge of the center panel to an outer edge of at least one contiguous opposing flap panel. The second flap panel is divided into two sub-panels by a slot and the fourth panel is divided into two sub-panels by a fold line. The first and third opposing flap panels have an elongated slot that are parallel to one another and to the center panel central fold line.

A second blank is dimensioned to coordinate with the first blank when the two blanks are in their folded configuration with the second blank overlying the first blank. The second blank has a second center panel with four edges and four flap panels contiguous with each edge that are separated from the center panel by an edge fold line. A first and a third of the flap panel have a contiguous pair of opposing end flaps that are separated from a neighboring flap panel by a slot.

A second central fold line of the second blank extends parallel to the central fold line of the first blank when the first and second blanks are in their assembled configuration with the second blank overlying the first blank. The second central fold line extends from one edge of the center panel to an outer edge of at least one of its contiguous opposing flap panel. Each contiguous end flap and flap panel is separated by a fold line, and each flap panel is separated from said second center panel by a fold line.

The second blank flap panels have a peripheral edge that is longer than half the distance between the central fold line and a parallel fold line, with the peripheral edge being an edge not parallel with the central fold line.

In accordance with an embodiment of the invention, a box is formed and filled using the above blanks. The first blank first and second flap panels are rotated about their fold lines, from the plane of the first blank toward a position in which the first flap panel's peripheral edge and the second flap panel's peripheral edge are separated by a distance equal to or less that the distance between the first flap panel fold line and the second flap fold line. A support film member is secured to the first and second flap panels in a position and dimensioning to be taut when the container is in a rectangular or square cross-sectional configuration and flaccid when said container is in a hexagonal configuration. The second blank's first flap panel is then fixed to the first blank's first flap panel and the second blank's second flap panel to the first blank's second flap panel. The second blank's second flap panel having its fold line parallel to the first blank's central fold line. This places the central fold line of the second blank parallel to the central fold line of the first blank when in the assembled configuration. The container is then folded to a substantially flat configuration for transportation to a user.

In accordance with an embodiment of the invention, to use the box, the formed box is unfolded to a substantially rectangular or square configuration by folding at least one flap panel about its fold line to a position superadjacent a central panel and conforming the container to a hexagonal cross-section.

In accordance with an embodiment of the invention, the support film member is secured to the first blank's first and second flap panels by passing each of two ends of the support film member through one of the elongated slots and fixing the two ends of the support film to its respective flap panel.

In accordance with an embodiment of the invention, the support film member can be a pouch, and an article can be inserted into the pouch while the box is in a hexagonal cross-sectional configuration. The box can be supported in its hexagonal cross-sectional configuration on a substantially horizontal planar surface and positioned with its first blank center panel central fold line substantially vertical relative to horizontal planar surface. An article can then be inserted into the pouch while the support film of the pouch is flaccid. The pouch can also have a flap member and an adhesive containing region, with the flap member folding onto the adhesive containing region to secure the article product within the pouch.

In accordance with another embodiment of the invention, the support film can be secured to the first blank's first and second flap panels by wrapping a first end of a first support film around a peripheral edge of the first blank's first flap panel and a second end of the support film around a peripheral edge of the first blank's second flap panel. A second support film can then be secured to the first blank's first and second flap panels by passing each of two ends of said support film through one of the elongated slots and fixing each of the two ends of to its respective flap panel. The second support film can be in the form of a pouch and the product inserted into the pouch while the box is in a form having a hexagonal cross-section. The pouch can have a flap member and an adhesive containing region with the flap member being folded onto the adhesive containing region to secure the product within the pouch.

In accordance with a further embodiment of the invention, a box for retaining products, especially fragile products, for shipping comprises a first center panel with four flap panels contiguous with the edges of the first center panel. The four flap panels are separated from the center panel by a flap panel fold line. The first center panel has a central fold line extending parallel to two of the flap panel fold lines that extends from the edge of the center panel to an outer edge of at least one of its contiguous flap panels. The opposing first and a second flap panels have an elongated slot that are parallel to the other elongated slot and to the first center panel and second central fold lines.

A second blank has a second center panel is contiguous with, and separated by a fold line, four flap panels, with a second central fold line extending parallel to the first central fold line. The second central fold line extends from an edge of the second center panel to an outer edge of at least one of its contiguous flap panels. At least one contiguous flap panel has one of the first or the second central fold line extending from its contiguous edge with the center panel to its outer edge. The flap panel is folded about its fold line to a position superadjacent to its contiguous central panel, and the box is conformed to a hexagonal cross-section. The box includes a support film having two ends is secured at each end to a panel contiguous with a center panel, along a line that is parallel to the central fold line. The support film is positioned and dimensioned to be taut when the box is in a rectangular or square cross-sectional configuration and flaccid when the box is in a hexagonal configuration.

At least one end of said support film can pass through the elongated slot from the interior side of the elongated slot containing panel to the exterior side of the elongated slot containing panel, and then secured to the exterior side of the elongated slot containing panel. The support film can be a pouch with the elongated slots being substantially midway between the edges of the panel to which it is attached. The support film can also be secured to the panels at a position proximate one of the center panels for supporting an article between the support film and the center panel.

In accordance with a further embodiment of the invention, a package is formed and filled by using at least one blank having a first blank center panel and four flap panels and a first central fold line extending parallel to two flap panel fold lines. The central fold line extends from an edge of the center panel to an outer edge of at least one of its contiguous flap panels. The first and a second of the four flap panels being on opposing sides of said first center panel.

A second center panel is contiguous with a flap panel at each of its four edges, and separated therefrom by an edge fold line. At least one of the flap panels has a pair of opposing end flaps contiguous therewith and separated therefrom by a fold line. A second central fold line is parallel to the first central fold line and extends from an edge of the center panel to an outer edge of at least one of its contiguous flap panels. The pair of opposing end flaps are each separated from a neighboring flap panel by a slot, and each contiguous end flap and flap panel is separated by a fold line.

In accordance with a still further embodiment of the invention the box is assembled by rotating the two flap panels contiguous with the first central panel about their fold lines, from the plane of the first central panel toward a position in which the two flap panels are separated by a distance equal to or less that the distance between the two flap panel fold lines with said first central panel. A support film is secured to the first two flap panels. A second center flap panel is fixed to a first center panel flap panel that has the support film secured thereto, forming a box. The box is folded to a substantially flat configuration, for transportation to a user.

In accordance with a further embodiment of the invention a flattened box is unfolded to a substantially rectangular or square configuration, and at least one flap panel is folded about its fold line with a center panel to a position superadjacent to the center panel. The box is then conformed to a hexagonal cross-section and supported in its hexagonal cross-sectional configuration on a substantially horizontal planar surface. The box is positioned with its first blank center panel central fold line substantially vertical relative to said substantially horizontal planar surface. An article is then insert into the box for support by the support film member while said support film member is flaccid. The support film can be a pouch, and inserting an article into the box for support by the support film while it is flaccid comprising inserting an article into the pouch. The at least one flap panel is folded about its fold line with a center panel from the position superadjacent to the center panel, to an end closure position and the box is restored to its square or rectangular cross-sectional configuration. The box is then sealed as for example, by applying an adhesive tape to the ends of the box.

BRIEF DESCRIPTION OF DRAWINGS

The invention will be described with the accompanying drawings, in which:

FIG. 12 is a perspective view of the box on end in its hexagonal configuration, and having a pouch and an article being inserted into the pouch, in accordance with an embodiment of the present invention.

FIG. 13 is a plan view of a support film prior to being folded into a pouch configuration, in accordance with an embodiment of the present invention.

DETAILED DESCRIPTION

Definitions

It is advantageous to define several terms before describing the invention. It should be appreciated that the following definitions are used throughout this application. Where the definition of terms departs from the commonly used meaning of the term, applicant intends to utilize the definitions provided below, unless specifically indicated.

For the purposes of the present invention, the term "box" refers to an enclosure of any size and shape formed from a single or multiple bonded corrugated sheet that has the appropriate score lines, as well known in the art. The terms package and container are used herein interchangeable with the term "box".

For the purposes of the present invention, the term "clearance space" as used herein, refers to the space between flap side edges and an adjacent side wall, when the box is in its erected configuration.

Figures 1A, 1B:
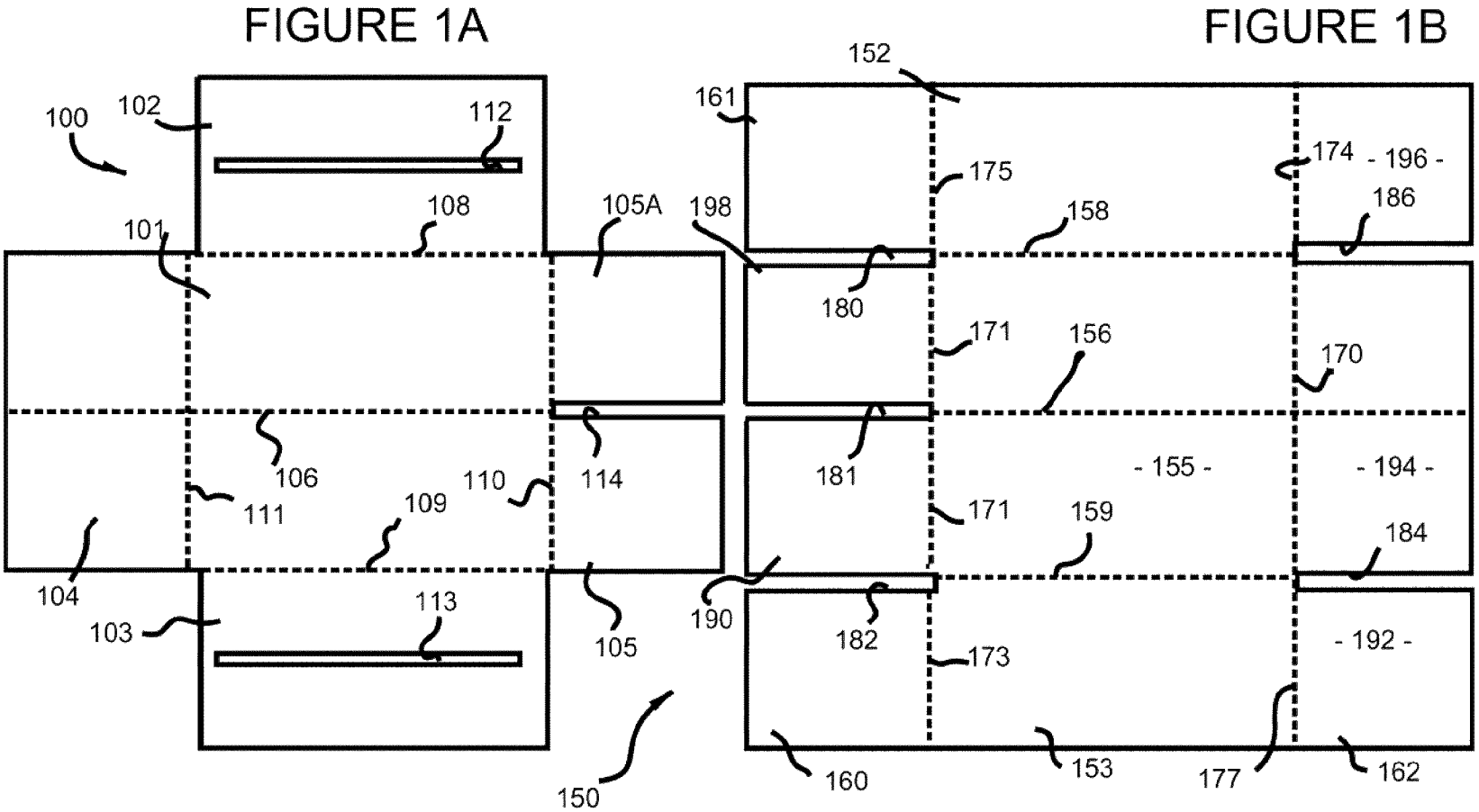
FIG. 1A is a plan view of a blank for making a first half of the box of the present invention.
FIG. 1B is a plan view of a blank for making a second half of the box of the present invention.

For the purposes of the present invention, the term "slot" refers to the manufacturing method that makes a cut that can be approximately, 3/16 of an inch wide between adjacent bottom flaps, or wider. For example, 114, 180, 186, 184, 181, and 182 represent slots as illustrated in FIGS. 1A and 1B and provide clearance space.

For the purposes of the present invention, the terms "corrugated paper", corrugated plastic, and the term "corrugated board" are used interchangeably, and are inclusive of single, double and triple wall corrugated materials for shipping boxes, as well known in the art.

For the purposes of the present invention, the term "double wall" refers to corrugated material that has two corrugated layers separated by a flat sheet and two outer flat sheets.

Figure 4A:
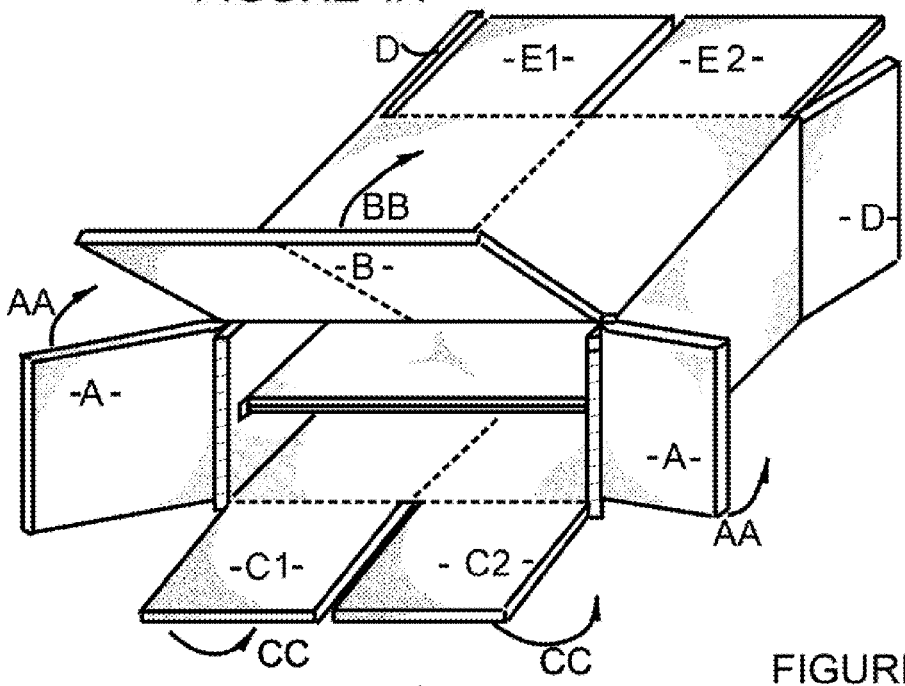
FIG. 4A is a perspective view of the assembled box open to a rectangular cross-section, in accordance with an embodiment of the present invention.
Figure 4:
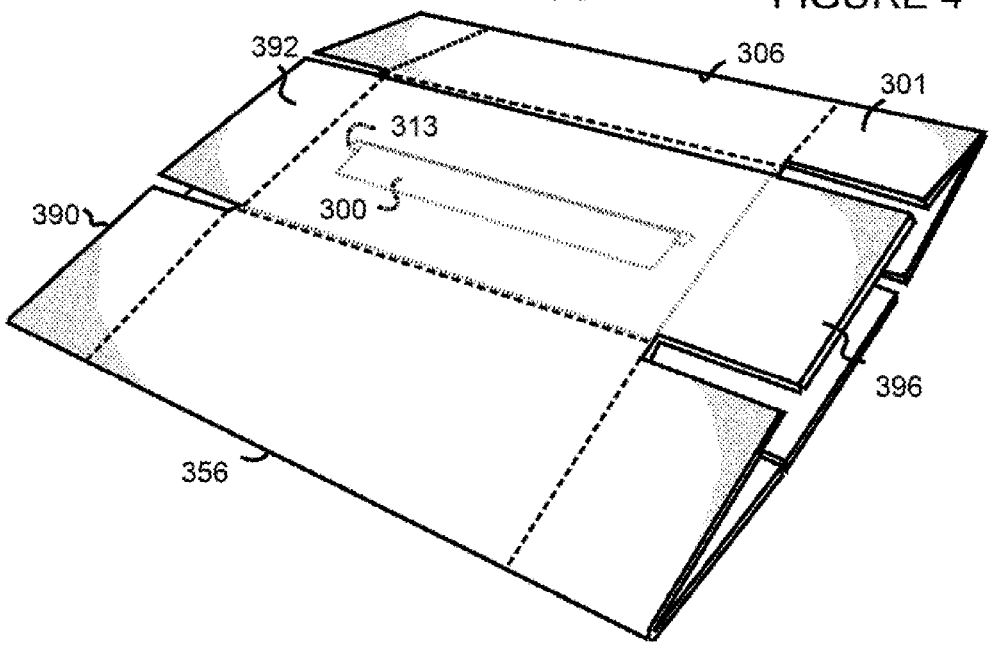
FIG. 4 is a perspective view of the assembled box folded flat, in accordance with an embodiment of the present invention.

For the purposes of the present invention, the term "knock down" refers to the box when it is flattened as illustrated, for example, in FIG. 4 herein.

Figure 5:
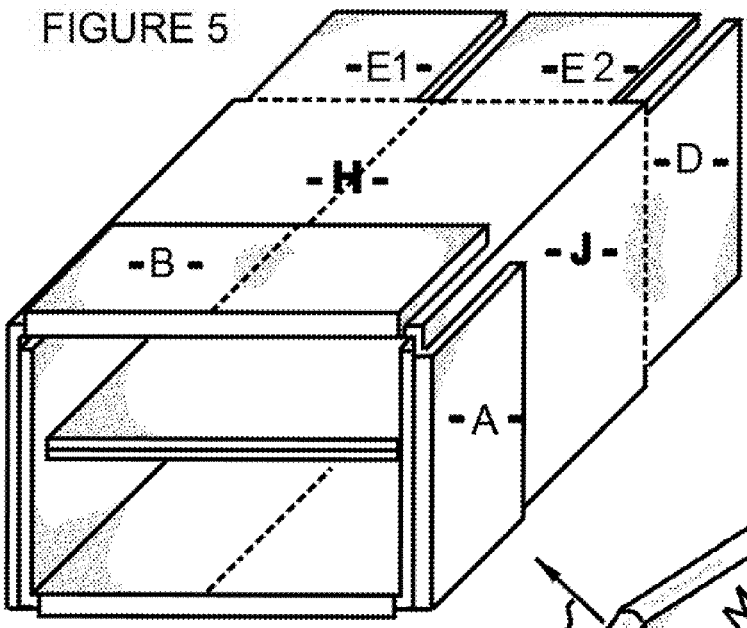
FIG. 5 is a perspective view of the erected box with end flaps and end panels folded superadjacent against the central panels and the side panels that are between the central panels, in accordance with an embodiment of the present invention.
Figure 6:
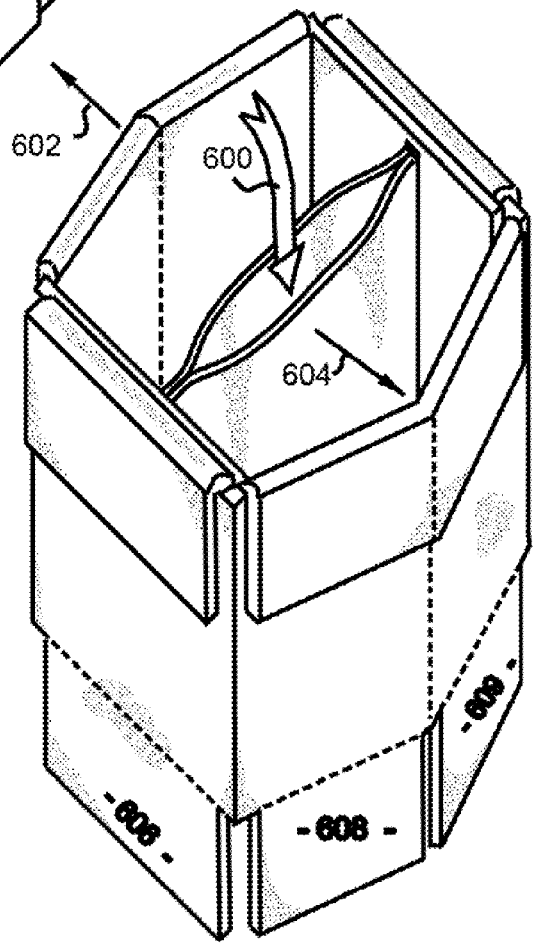
FIG. 6 is a perspective view of the box of FIG. 5, standing on end in its hexagonal configuration, in accordance with an embodiment of the present invention.

For the purposes of the present invention, the terms "opened", "assembled", and "erected" refers to the configuration of the box as illustrated for example, in FIGS. 5 and 6 herein When erected, the box can be, or has been filled with product.

For the purposes of the present invention, the term "score lines" may also be referred to as "fold lines" or "crush lines". Forming fold lines in blanks from which boxes are made is well known in the art, and any desired one of the well known techniques can be used. As seen in FIGS. 1A and 1B, reference numbers 108, 109, 110, 11, 158, 156, 159, 170, 171, 173, 174, 170, and 177, indicate typical score lines.

For the purposes of the present invention, the term "score" refers to the manufacturing method that linearly crushes the corrugated sheet to enable a fold line to be formed, as well known in the art.

Figure 7:
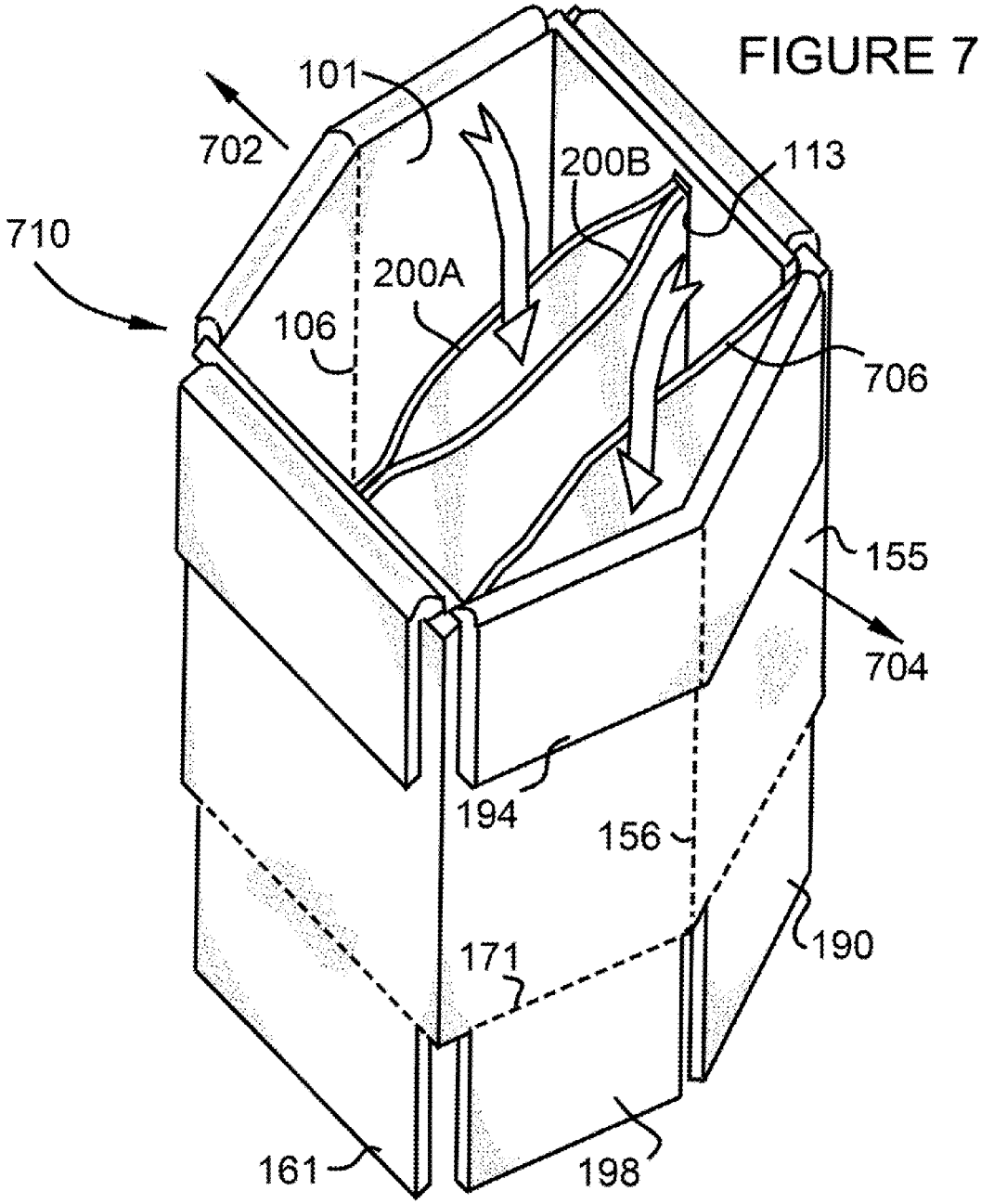
FIG. 7 is a perspective view of a box similar to that of FIG. 5, but with both a pouch and a retention film and standing on end in its hexagonal configuration, in accordance with another embodiment of the present invention.

For the purposes of the present invention, the terms "side panels" the side wall panels of a rectangular box, as for example, panels 101, 102, 103, 152, 153, and, 155 of FIGS. 1 and 7. In the case of a square box, two opposing sidewalls of the four sidewalls are referred to as end panels and the other two opposing side walls are referred to as side panels.

The terms end panels and side panels are terms of convenience and are used to identify a first pair of opposing side walls and a second pair of opposing side walls. While generally, end panels, such as 104, 105, 105A, 160, 161, 190, 192, 194, and 196 of FIGS. 1A and 1B, are narrower than side panels, the terms themselves have no criticality, and end panels can be wider than side panels. For the purposes of the present invention, the term "single wall" refers to corrugated material that has one corrugated layers separated by a flat sheet and two outer flat sheets.

For the purposes of the present invention, the term "flap" and/or "flaps" may be used when referring to end panels.

For the purposes of the present invention, the term "substantially", as used herein means tolerance ranges normal used in the paper box industry.

For the purpose of the present invention, the term "suspension layer" refers to the film structure that attaches to box panels for securing objects during shipping. Multiple suspension layers can be used and suspension layer can be used in combination with retention layer(s).

For the purpose of the present invention, the term "pouch" refers to a film structure that encloses and forms a suspension layer.

For the purpose of the present invention, the terms "pouch", "film", and "suspension layer" refers to structure that can be an anti-static/static dissipating material, and is preferably a material that will hold a product under tension when stretched. The material tends to return to its un-stretched form rather than to deform or elongated to a longer dimension, and thus, will hold a product firmly, and under tension. The product is accordingly not free to move, or rattle around in the box. The film is resilient and returns to its original shape when after being subjected to a vibration or jarring action. The film thus cushions and cradles the object being transported. The method in which films are joined to the walls of the box can include, by way of example, welding, heat activated adhesives, co-adhesives, pressure sensitive tapes, and hot melt glues. Epoxies and silicone adhesive can be used. Pressure sensitive tapes for the pouch structure are provided with a release film which is removed when the pouch is to be sealed closed.

Figure 10:
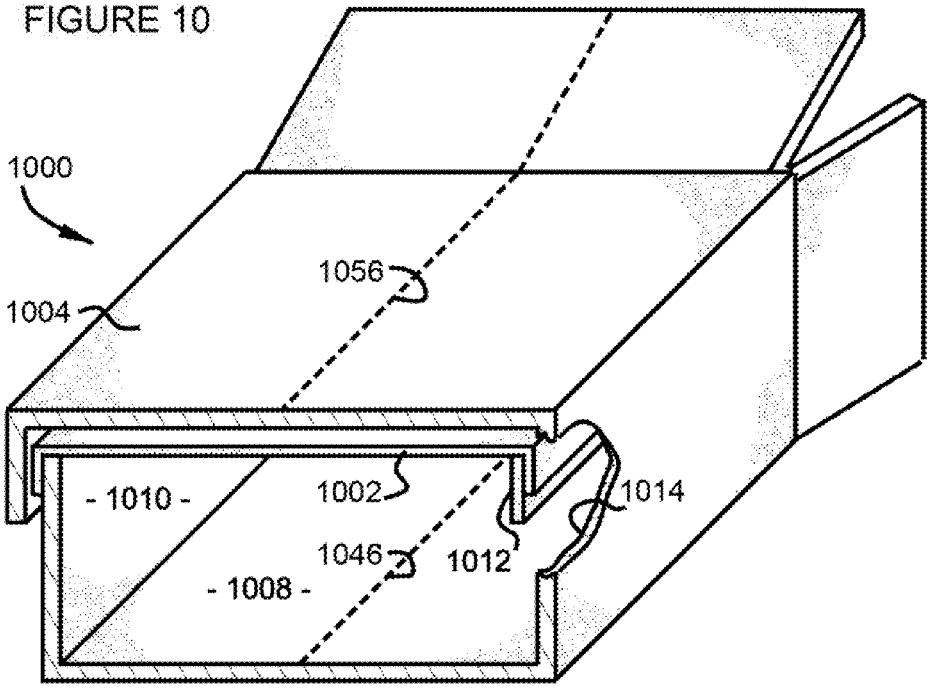
FIG. 10 is a perspective view, partly in cross-section, of a one piece blank design and containing a retention film, in accordance with an embodiment of the present invention.
Figure 11:
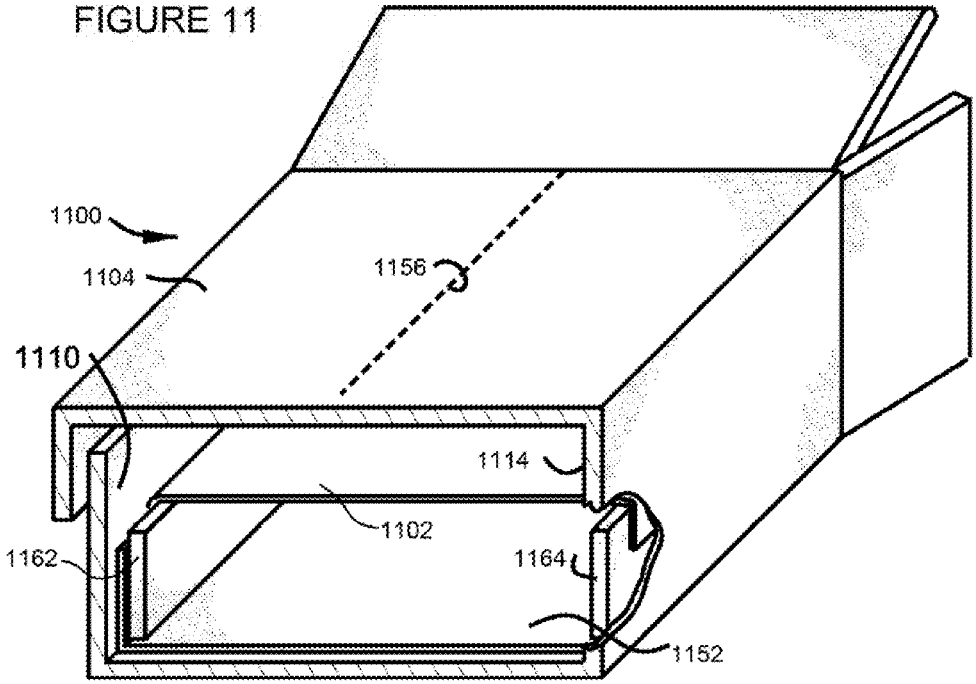
FIG. 11 is a perspective view, partly in cross-section, of a one piece blank design and containing a support film, in accordance with a further embodiment of the present invention.

For the purpose of the present invention, the terms "fixing" and "securing", when referring to the attaching of a panel of one blank to a panel of another blank, or the attaching of a retaining member such as 1164 of FIG. 11, or 1006 of FIG. 10, to a panel, means the attaching of two members together by an of the well known means, such as adhesives, including for example, a hot melt glue, heat activated adhesives, co-adhesives, or pressure sensitive adhesives, and by other known means such as staples, adhesive tapes and the like.

For the purpose of the present invention, the term "void fill" refers to any material used to fill the empty space around an object being shipped inside a box. More commonly known to those skilled in the art it refers to stuffing popcorn/peanuts, Bubble Wrap, airbags, paper product, foam and Styrofoam. Void fill can be used in conjunction with suspension and retention packages, but preferable, the suspension and retention packages of the present invention negate the need for void fill.

For the purpose of the present invention, the term "erected" refers to the box being unfolded as to have square corners and a closed bottom, as well known in the art.

For the purpose of the present invention, the term "RSC" means regularly slotted cardboard, as well known in the industry.

For the purpose of the present invention, the term "die cut panels" refers to the industry standard method of forming blanks such as illustrated in FIGS. 1A and 1B.

The term "substantially" as referred to herein indicates a near, close to relationship, not significantly departing from a particular quality. For example, while 50% would not be substantially 100%, but a value that provides the desired result though not exactly equal to the ideal or optimum value, would be considered to be substantially the exact, ideal, or optimum value. A substantially vertical article could depart from the perpendicular relationship with a horizontal plane, but would not depart to the extent that it begins to lose its stability or requires an external support to be self supporting.

DESCRIPTION

There are four simple advantages to the suspension packaging system of the present invention. The product provides exceptional cushioning and vibration protection while greatly reducing warehouse space, eliminating inner cushioning materials, saving labor, and reducing material costs.

In a preferred embodiment, the system uses a film pouch centered within a box that is secured in place by trapping the ends of the film between two layers of corrugated for exceptional strength. The film passes through the first corrugated layer utilizing a ⅜" tall slit and is then turned 90 degrees to be glued between the corrugated panels. The corrugated layers are completely glued as well to create an exceptionally strong box in its own right.

The firmly attached stretchable film can now be used for two purposes. First, as a pre-made pouch for loading items to be shipped in that is virtually indestructible. It requires the packer to keep both ends of the box open so that loading can be easily facilitated. Once the box is folded the film-pouch becomes taut and is ready for shipping. The design orients the box to be opened from the side so that the opening of the pouch is exposed to the user, thereby facilitating the insertion of an article or articles into the pouch.

In another embodiment, the film cooperates with a side wall of the box to form the equivalent of a pouch. In this embodiment, the article is retained between the taut film and the box, and this style of a box is referred to as a retention pack.

The box can be stood on end, that is, on its end flaps, to expose the pouch for easy insertion of an article into the pouch. The box is placed on a horizontal surface, as for example, a packing table, with the open end of the pouch.

Additionally, the film can be used as a platform for a separate pouch to be attached with a pressure sensitive adhesive, either residing on the pouch or on the film. This design orients the box to be opened from the top so that the film's full length and width are exposed.

A further aspect of the invention is that the film is trapped between two layers of corrugated that runs along the bottom of the box. The film starts from the left by having 1" of material trapped between the layers of corrugated material, and then passes underneath the inner corrugated layer leading to the opposing corrugated layer and passing underneath to be trapped between those layers. Typically this box would be shallower or less tall than prior art boxes and to the other embodiments of the invention.

The support film of the present invention is preferably a plastic which stretches up to about 40% with high load retention, that is, without distorting or deforming, or exceeding its yield point. In one embodiment anti-static/static dissipative films can be used.

The pouch can be a folded sheet or two sheets can be heat welded to form a pouch. Additionally, multiple pouches can be provided, advantageously, in spaced, parallel rows.

FIGS. 1A and 1B illustrate an embodiment of the present invention in which a pair of blanks, 100 and 150 is employed to make a box of the type illustrated in FIG. 4A. The first blank 100 has a central panel 101 which is bound by fold lines 108, 109, 110, and 111. The fold lines form the edges of the central panel 101 of the blank 100. Panel flaps 102, 103, 104, 105, and 105A are contiguous with the center panel 101.

The panels 102 and 103 can be provided with elongated slots 112 and 113 respectively, for use in securing the support film to the panels 102 and 103. The film 200 is centered within the box by passing it through the first corrugated layer utilizing a ⅜" tall slit and is then turned 90 degrees to be glued between the corrugated panels 102 and 152, and 103 and 153. The corrugated layers are completely glued as well to create an exceptionally strong box in its own right.

The film used is advantageously a transparent urethane 3 mils thick. The urethane film's unique properties of stretch ability and memory make film always return to original shape. These properties enable the film to absorb repeated shock and vibration.

The center panel 101 is provided with a central fold line 106 which extends across the center panel 101 and the flap panel 104. In the embodiment of FIG. 1A, the flap panels 105A and 105 are separated by a slot which serves to facilitate the step of folding flap panels onto the center panel, as illustrated in FIGS. 5 and 6.

With respect to FIG. 1B, fold lines 171, 158, 170 and 159 form the edges of the central panel 155 of the second blank 150 and separate the center panel 155 from the flap panels 194, 153, 152, 190 and 198. End flaps 160, 161, 192, and 196, are contiguous with flap panels 152, and 153 and separated therefrom by fold lines 174, 175, 173, and 177 respectively. Slots 180, 182, 184, and 186 are employed to provide clearance between flap panels and end flaps during the assembly steps.

The center panel 155 is noted to be bounded by fold lines 158, 159, 170, and 171, and is provided with a central fold line 156. The central fold line is employed during the steps of folding the box flat, as illustrated in FIG. 4, and in forming the hexagonal configuration as illustrated, for example, in FIGS. 6 and 7.

The attachment of a stretchable support film 200 to the blank 100 is most readily achieved by folding the flap panels 103 and 102 toward each other thereby bringing the elongated slots 112, and 113 sufficiently close together to facilitate the insertion of one end of the support film 200 into the elongated slot 113 and the other end into the elongated slot 112. The ends of the support film are folded against their respective flaps panels. The film is preferably formed of a plastic that is stretchable up to 20% and more preferably, up to 40% without exceeding its yield point. The film can be used as a platform for a separate pouch that is attached with a pressure sensitive adhesive, either residing on the pouch or the film. This design orients the box to be opened from the top so that the film's full length and width are exposed.

Figure 2:
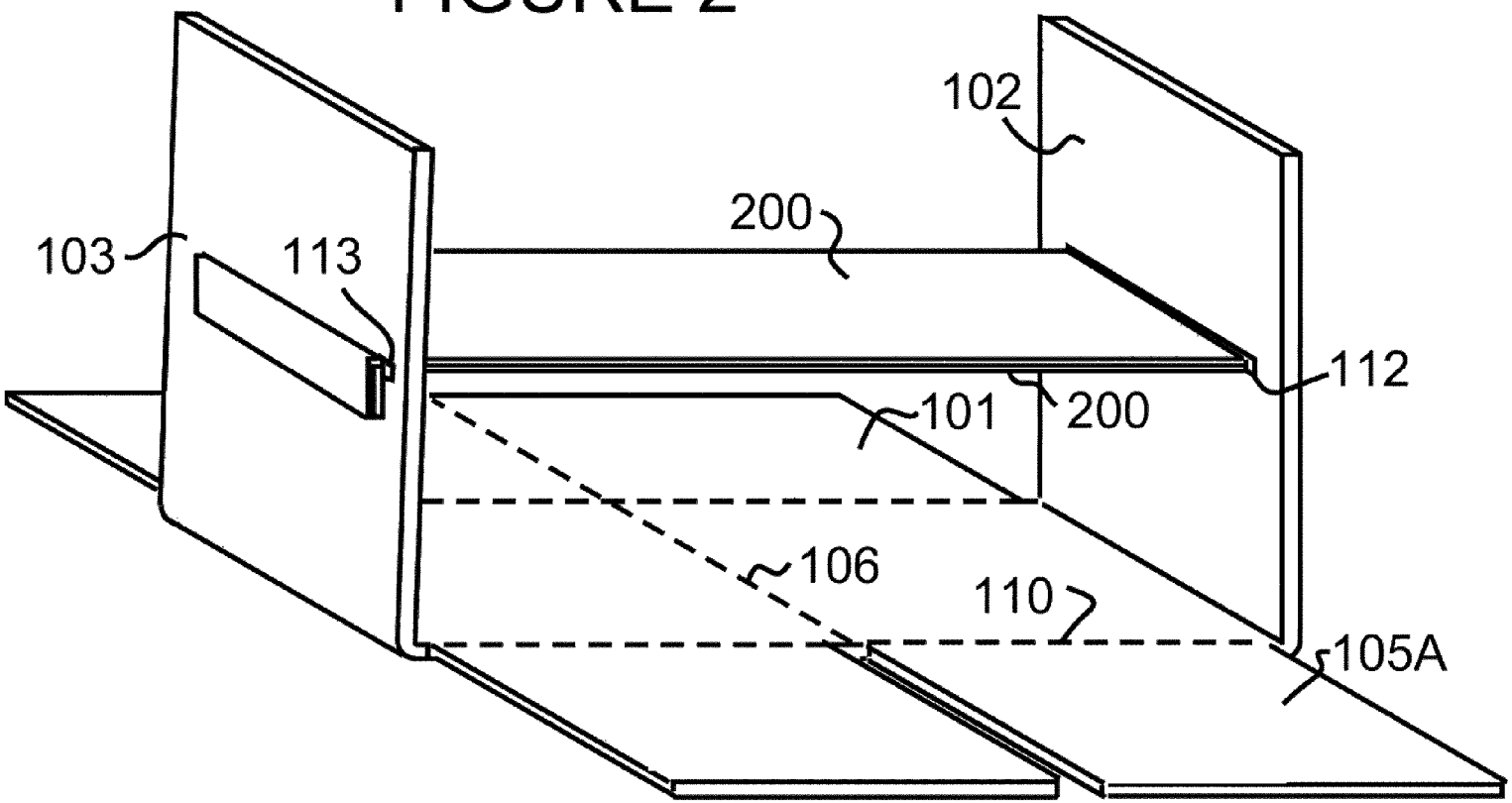
FIG. 2 is a perspective view of the first blank illustrating the first folds in accordance with an embodiment of the present invention.
Figure 3:
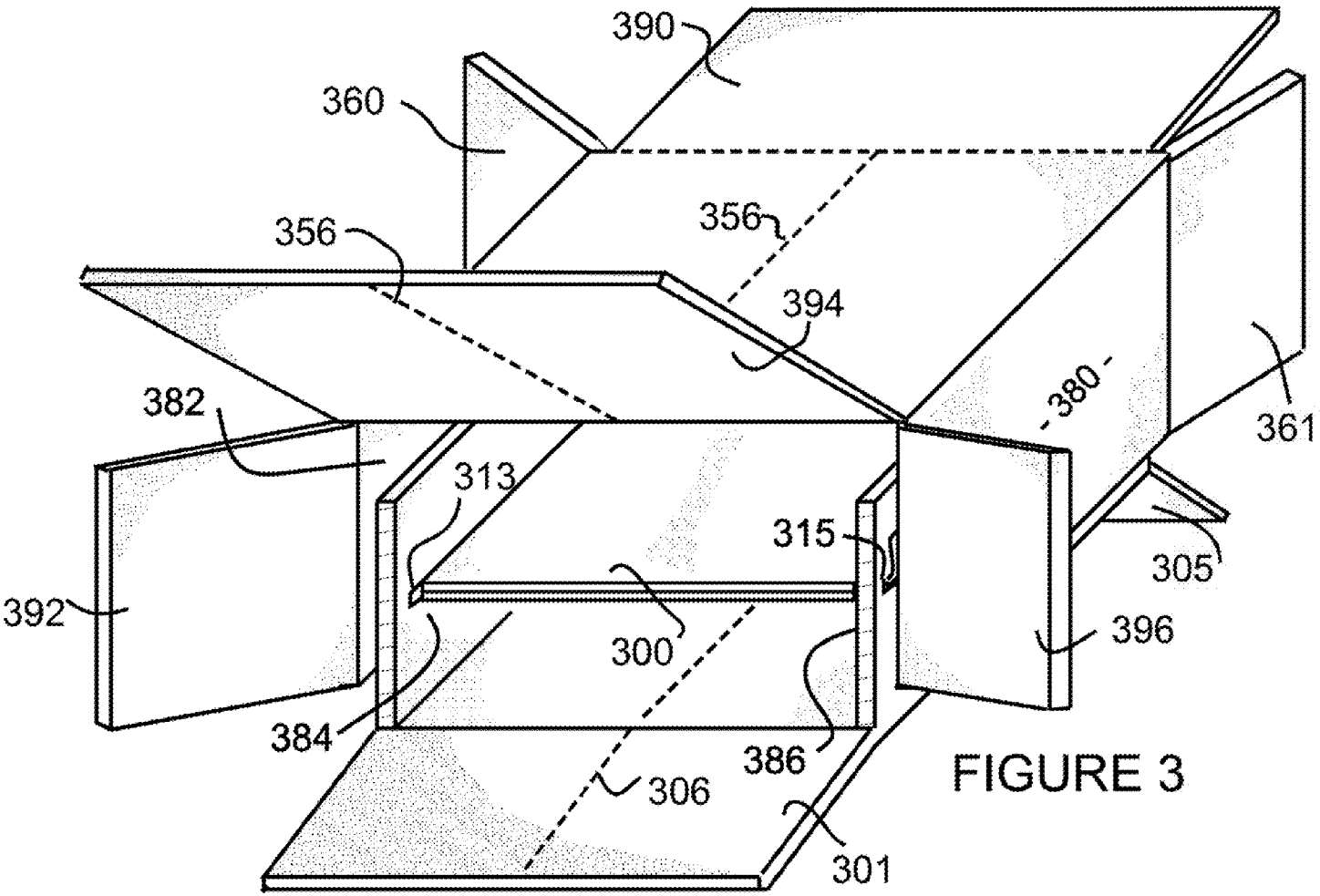
FIG. 3 is a perspective view of the box prior to the two blanks being affixed to each other, in accordance with an embodiment of the present invention.

FIG. 3 shows an inner blank having flap panels 301 and 305, a central fold line 306 and a support film 300 secured through elongated slots 313 and 315 to side flap panels in the manner of the embodiment of FIG. 2. An outer blank having flap panels 394, 390, and end flaps 361, 396, 392 and 360 contiguous with the flap panels, is moved toward the inner blank until the flap panel 380 is registered with the flap panel 386 and the flap panel 382 is registered with the flap panel 384. The registered flap panels are secured to each other advantageously by means of an adhesive, such as hot melt glue.

FIG. 4 shows the formed box knocked down to a flat configuration, and ready to be stacked with additional formed and flattened boxes.

FIG. 4A shows the box in a first stage of being opened for use by the person packing the box. The panels on one end of the box, (see for example panels E1, E2, and D, and D) are maintained in the same plane as the panels with which they are contiguous, whereas panels A, A, C1, C2 and B, are rotated in the direction of arrows AA, AA, CC, CC, and BB, respectively.

FIG. 5 shows the panels rotated to a position in which they lie against (are superadjacent to) their respective contiguous panels. Thus, panel A is flat against panel J, and B is flat against panel H. Panels E1, E2, and D are shown non-rotated, that is, they are maintained in their positions in-line with their contiguous panels, H and J respectively.

FIG. 6 shows box after the center panels are forced outwardly at their central fold lines, as indicated by arrows 602 and 604. The box is preferably on a normal, horizontal surface of a work table, as seen standing on flaps 606, 608, and 609. It should be understood that the dimensions of the panels 606, 608, 609, and the panels that are not seen in the figure, serve as box support panels and advantageously are dimensioned such that their support edges lie in the same plane, which is the plane of the support surface. If one or more panels is longer than the others, the box can become unstable and cannot support itself in a vertical orientation. The term vertical orientation refers to the orientation of the central fold lines relative to the surface on which the box is standing.

FIG. 7 illustrates an alternate embodiment in which the box is provided with a pouch member having two support films 200A and 200B, and a retentions support film 706. The box, indicated generally as 710, is shown with the panels 161, 198, and 190 (visible in the view of FIG. 7) having their outer edges lying in the same plane. The outermost edges are the lowermost edges of the box when the box is vertically oriented and standing on a work table. The term "vertically oriented" refers to the orientation of central fold lines 106 and 156, relative to the horizontal plane of a work table (not shown). The support films 200A, 200B, and 706 are relaxed or flaccid, when the box is in the hexagonal configuration illustrated in FIG. 7. In this configuration, an article can be inserted into the open pouch and between the support film 706 and the adjacent box wall which is bent along fold lines 106 and 156, that is, "V" shaped. The box is opened from its rectangular or square cross-section as seen in FIG. 5, for example, to the hexagonal cross-sectional configuration of FIG. 7, by apply pressure in the direction indicated by arrows 702 and 704. The flap panel 194 when folded onto the center panel 155 tends to hold or lock the box in its hexagonal cross-section configuration. Similarly, the flap panel (not visible) folded against center panel 101, tends to hold or lock the box in its hexagonal cross-section configuration. The use of one slotted panel and one full panel as illustrated in FIGS. 1A and 1B makes it easier to form the box into a hexagonal configuration, while the use of opposing unslotted panels serves to provide greater rigidity to the hexagonal configuration.

Figure 8:
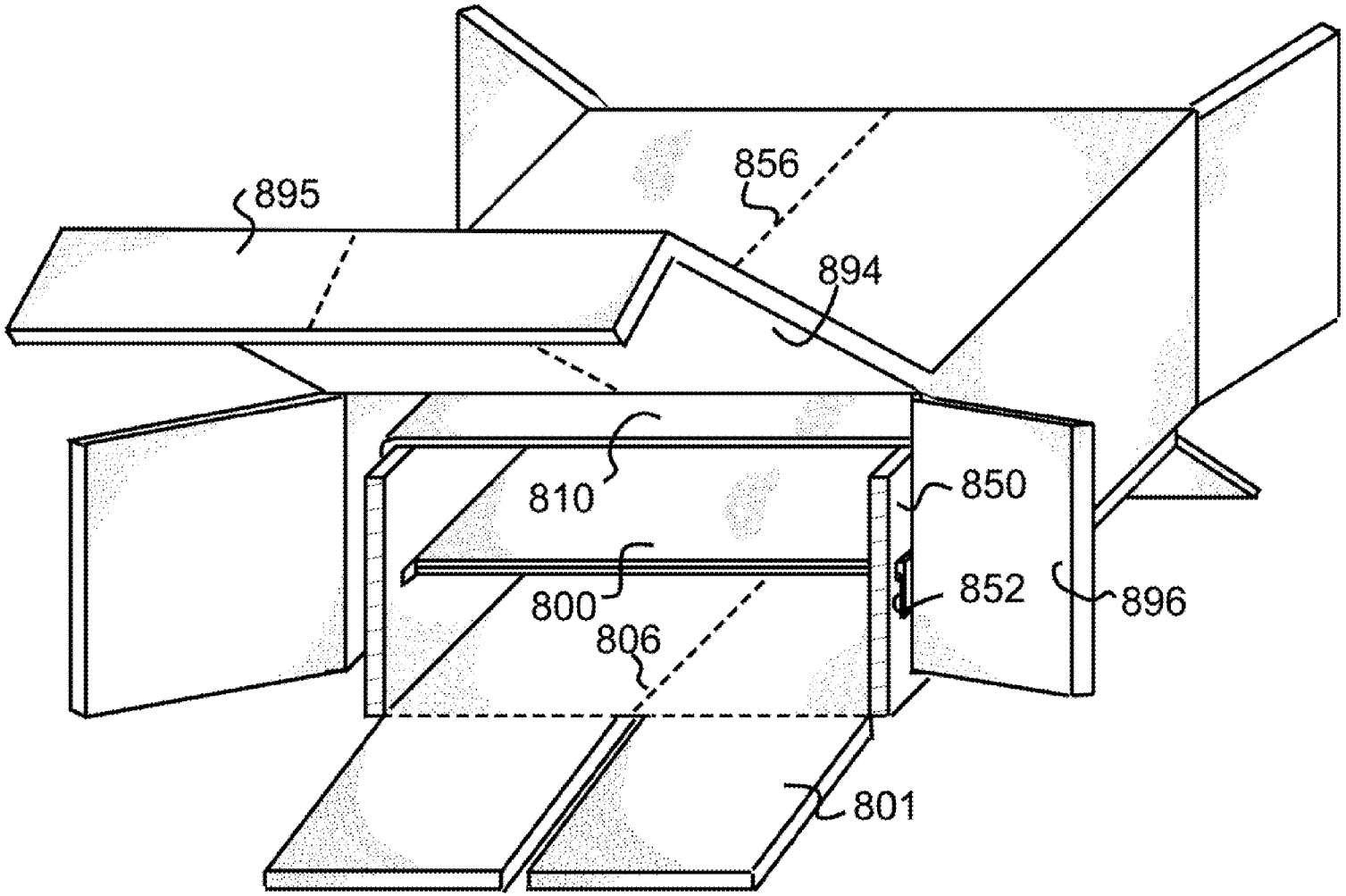
FIG. 8 is a perspective view of a box being assembled and shown open to a rectangular cross-section similar to the box of FIG. 3, but with an additional fold over end flap for extra rigidity and strength, in accordance with an embodiment of the present invention.

In the embodiment of FIG. 8 the flap panel 894 is provided with a reinforcing flap 895. Flap 894 is folded over the end flaps 896 and flap panels 801, and flap 895 wraps around the center panel 806 and is secured thereto by an adhesive, tape, staple, or other well known method. The central fold 856 is noted to extend to the flap panel 894 and the reinforcing flap 895. In this embodiment, a pouch 800, formed of two sheets of plastic film, and a retention support film 810 are employed to accommodate two different articles.

Figure 9B:
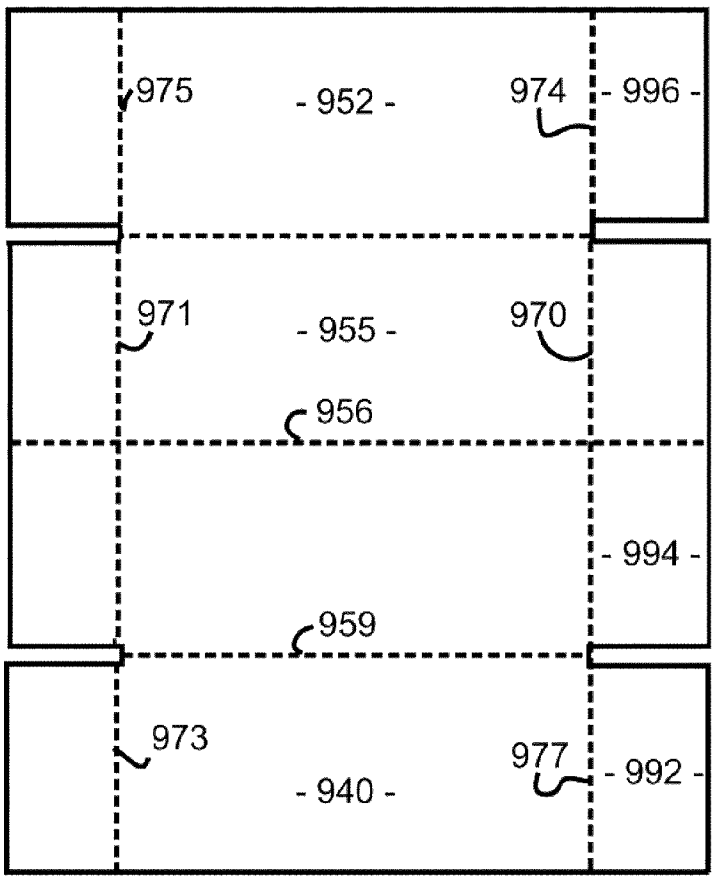
FIG. 9B is an additional blank design in accordance with an embodiment of the present invention.
Figure 9A:
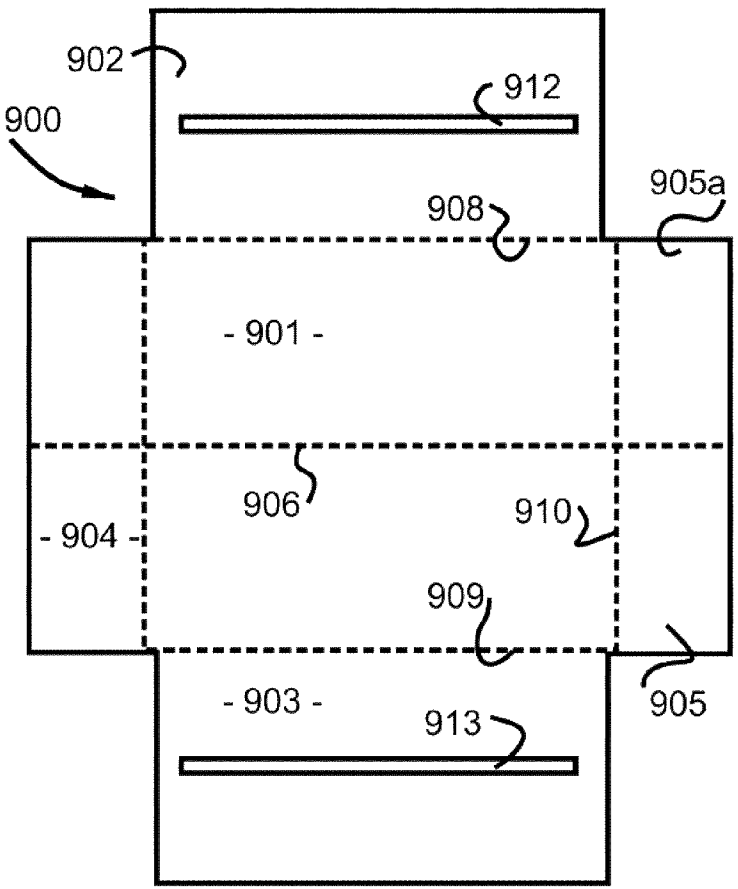
FIG. 9A is a further design of a blank in accordance with an embodiment of the present invention.

FIGS. 9A and 9B show an alternate embodiment which generally corresponds to the embodiment of FIGS. 1A and 1B. However, the flap panels 904, 905, and 905A are shorter than the corresponding flap panels 104, 105, and 105A of FIG. 1. Additionally, the embodiment of FIGS. 9A and 9B do not employ slots between the flap panel sections 905 and 905A. The reference numbers of FIGS. 1A and 1B are a one hundred series, whereas the reference numbers of FIGS. 9A and 9B are in a corresponding 900 series. Thus, slots 112 and 113 correspond to slots 912 and 913, flap panels 102 and 103 correspond to flap panels 902 and 903, etc.

FIG. 10 illustrates another embodiment of a box indicated generally as 1000, formed from a single blank. The box employs two central fold lines 1046 and 1056, corresponding to central fold lines 906 and 956 of FIGS. 9A and 9B. The center panel 1004 is formed contiguous with a flap panel 1006, which in turn is contiguous with a second center panel 1008, which in turn is contiguous with a flap panel 1010. Contiguous panels should be understood as being separated by a fold line. The support film 1002 is secured around the upper edge of the flap panel 1010 and secured between a retainer member 1006 and flap panel 1012.

FIG. 11 illustrates a box indicated generally as 1100, which corresponds generally to the box 1000 of FIG. 10, with a few exceptions, relating to the support film design. In this embodiment, a support film, which is advantageously in the form of a pouch, is wrapped over and around a retainer member 1162 and secured between the retainer member 1162 and the panel 1110. Similarly, the support film has its other end wrapped over and around a retainer member 1162 and is secured between the retainer member 1164 and the panel 1114. The panel 1104 is a center panel having a central fold line 1156 for the functions previously described.

FIG. 12 show a box 1200, having a pouch member 1201, formed of two sheets of plastic film or a folded over single sheet. The article 1208 is inserted into the pouch and a fold over flap region 1202 of pouch 1201 is folded onto an adhesive section 1206 of the fold section 1204 of pouch 1201. The adhesive can be a two sided adhesive tape bonded on one side to the sheet 1204 and bonded on the other side to the flap section of sheet 1202. The adhesive tape is provided with a release film that is removed after the article is inserted into the pouch, thus exposing the adhesive layer.

FIG. 13 is a plan view of a pouch member 1201 having an adhesive layer 1206 and a flap region 1202. The pouch can alternatively be formed of two separate plastic sheets heat welded to form a pouch, as illustrated in FIG. 12.

Figure 14:
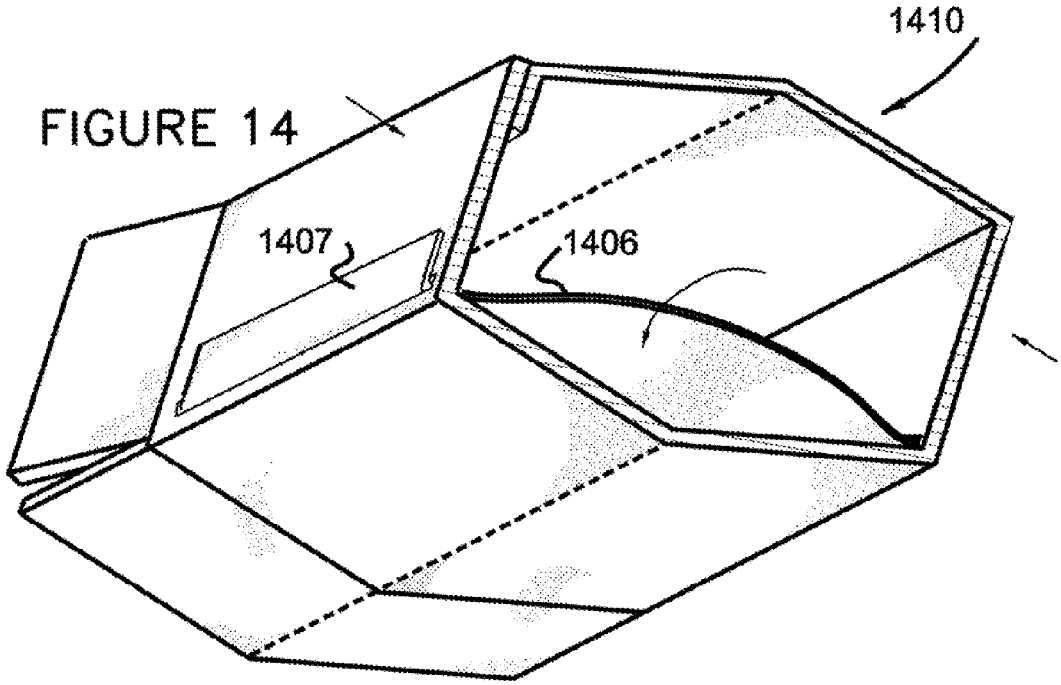
FIG. 14 is a perspective view, partly in cross-section, of a one piece blank design and containing a retention film, in accordance with a further embodiment of the present invention.

FIG. 14 shows an alternative embodiment of a one piece box 1410, similar to one piece box 1000 of FIG. 10, except that the retention sheet 1406 is secured to the box using elongated slots as seen for example in the embodiments of FIGS. 2, 4A, 6, 8, and 12. The exposed ends 1407, of the support film 1406, are preferable cover over with a layer of corrugate material.

Figure 15:
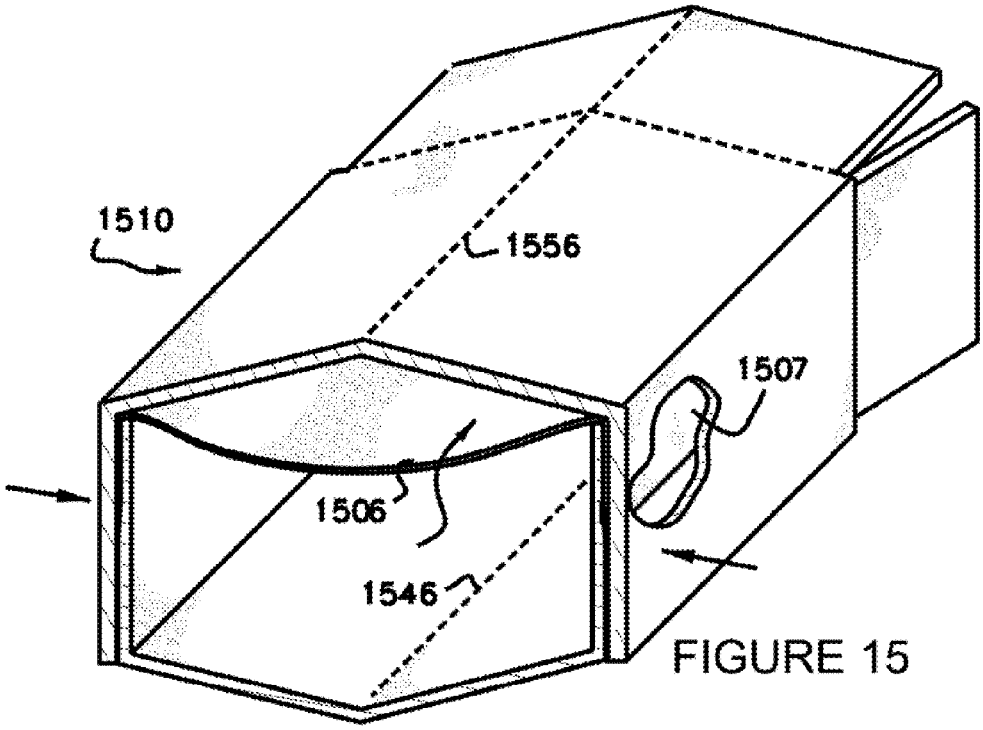
FIG. 15 is a perspective view, partly in cross-section, of a two piece blank design and containing a retention film, in accordance with a further embodiment of the present invention.

FIG. 15 shows a box 1510 which is similar to the design of the boxes of FIGS. 7 and 8 except that is only uses a single retention film 1506 for supporting and article. The box is opened to its hexagonal form by folding along central fold lines 1546 and 1556. The film 1506 has a fold over region 1507 secured between two panels of the box, in the manner previously described in relation to the similar boxes.

Figure 16:
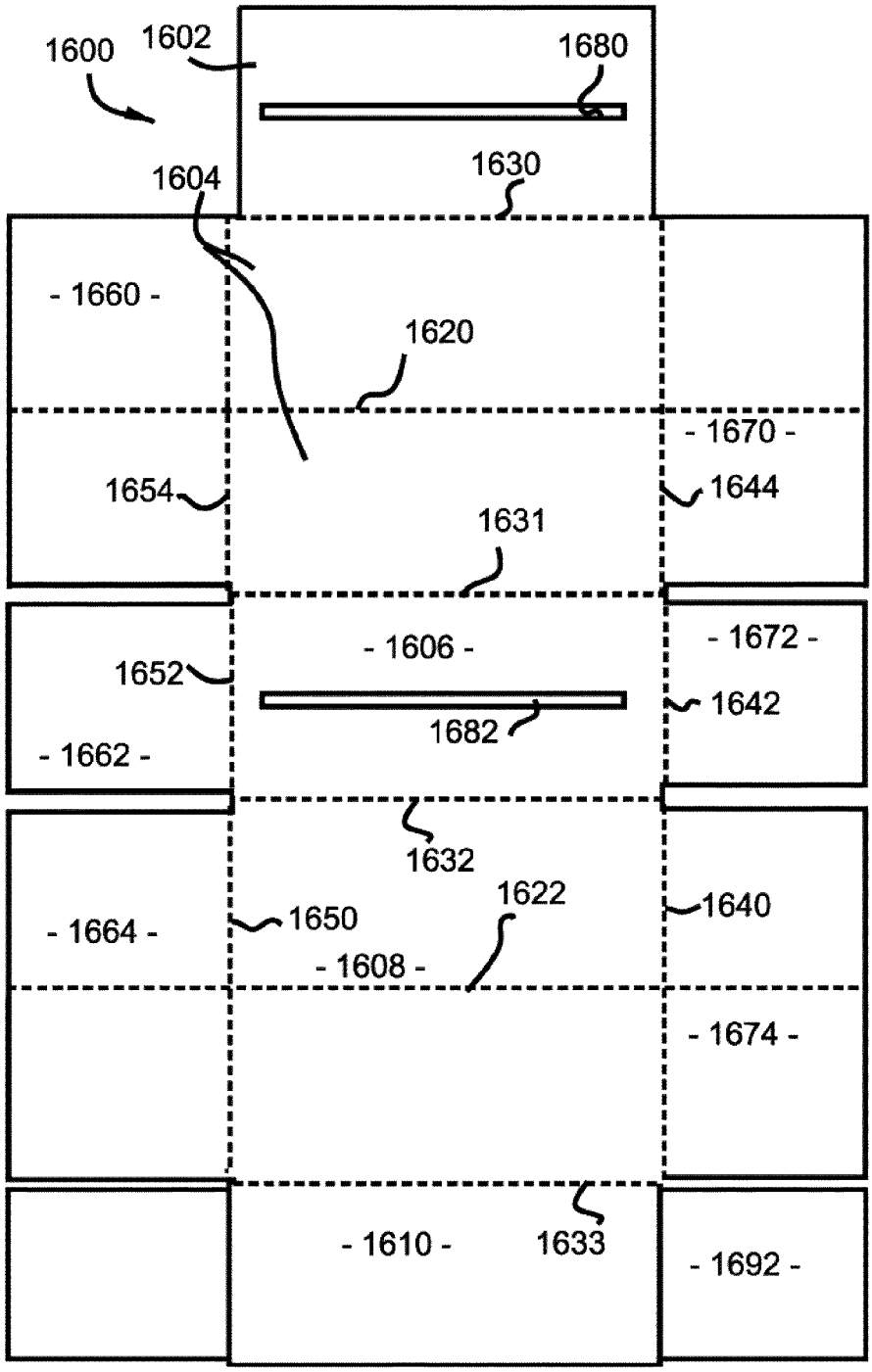
FIG. 16 is a plan view of a blank for making a one piece box, in accordance with a further embodiment of the present invention.

FIG. 16 illustrates an embodiment of a blank, indicated generally as 1600, that corresponds generally to the embodiment of FIG. 14. It is noted that the elongated slot 1682 can preferably be positioned about midway between fold lines 1631 and 1632, and slot 1680 are be correspondingly halfway between fold line 1630 and the outer peripheral edge of panel 1602. In an embodiment of the invention, the suspension layer is two inches above the box floor and three inches from the top of the box.

Alternatively, the elongated slot 1680 and 1682 can be positioned adjacent fold lines 1630 and 1631 respectively. In this later configuration, the support film can be used to retain an article between the film and the central panel 1604. It should be understood that multiple layers of film can be used, and can be all pouch configurations, or combinations of pouches and single sheet of film.

FIG. 16 shows a single blank which is similar to the two piece blank system of FIGS. 9A and 9B. Essentially, panel 1602 and elongated slot 1680 of blank 1600 correspond to panel 902 and slot 912 of blank 900. Central panel 1604 and central fold line 1620 of blank 1600 correspond to center panel 901 and central fold line 906 of blank 900. Panel 1606 and elongated slot 1682 correspond to panel 903 and slot 913.

Center panels 1608 and central fold line 1622 of blank 1600 correspond to center panel 955 and central fold line 956 of the blank of FIG. 9B. Panel 1610 and its fold line 1633 correspond to panel 940 and its fold line 959. Panels 1662 and 1670/1672 correspond to panel 996 of FIG. 9B and its opposing panel. Panel 1674 and fold line 1640 correspond to panel 994 and fold line 970. Panel 1692 corresponds to panel 992 of the embodiment of FIG. 9B.

It can be seen that panel 952 of FIG. 9B has no corresponding panel in the embodiment of FIG. 16, because an overlap panel is not required in a one piece design. Other corresponding panel relationships will be evident to one skilled in the art, even though not specifically noted herein.

It is noted that FIG. 16 illustrates an embodiment of a blank, indicated generally as 1600, that corresponds generally to the embodiment of FIG. 14. It is noted that the elongated slot 1682 can preferably be positioned about midway between fold lines 1631 and 1632, and slot 1680 are be correspondingly halfway between fold line 1630 and the outer peripheral edge of panel 1602.

Alternatively, the elongated slot 1680 and 1682 can be positioned adjacent fold lines 1630 and 1631 respectively. In this later configuration, the support film can be used to retain an article between the film and the central panel 1604. It should be understood that multiple layers of film can be used, and can be all pouch configurations, or combinations of pouches and single sheet of film.

In the pouch design, where a pair of flaps extends through each of the elongated slots, one flap can be folded upward from the suspension layer against the wall and the other folded downward going against the wall. These flaps are extensions of the suspension layer and are what secures it to the corrugated box. It should be noted that the middle section of the film, that is, the region between the points at which the film is secured to the walls of the box, is the same dimension as the interior box footprint, in order to provide a taut film configuration.

Once the pouch(s) are filled the box can then be closed by bending in the top four box flaps over the scored fold lines and taping them down. The last step is to tape close the box flaps. With the box flaps closed and taped, the box is ready for shipment via any common carrier.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as described by the appended claims, unless they depart there from.

BROAD SCOPE OF THE INVENTION

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure, the following abbreviated terminology may be employed: "e.g." which means "for example."

What is claimed is:

1. A pair of blanks for forming a box, comprising, a first blank, said first blank having a first center panel having four edges and four flap panels, each of said four flap panels being contiguous with one of said four edges of said first center panel, and separated therefrom by a flap panel fold line, a first and a third of said four flap panels being on opposing edges of said first center panel and a second and a fourth of said four flap panels being on opposing edges of said first center panel, said first center panel of said first blank having a first central fold line extending parallel to said flap panel fold line separating two opposing flap panels, and extending from an outer edge of said first of said four flap panels to an outer edge of said third of said four flap panels, a second blank, said second blank being dimensioned to coordinate with said first blank when said first blank and said second blank are in their folded configuration and said second blank overlies said first blank, said second blank having a second center panel having four edges and four flap panels, each of said four flap panels being contiguous with one of said four edges of said second center panel, and separated therefrom by an edge fold line, a first and a third of said flap panels having a pair of opposing end flaps contiguous therewith, said pair of opposing end flaps being separated from a neighboring flap panel by a slot, said second blank having a second central fold line extending parallel to said first blank first central fold line when said first blank and said second blank are in their assembled configuration and said second blank overlies said first blank, said second blank second central fold line extending from an outer edge of a first of said flap panels to an outer edge of a third opposing flap panel, and wherein said second blank pair of opposing end flaps are each separated from a neighboring flap panel, and wherein each contiguous end flap and flap panel is separated by a fold line, and each flap panel contiguous with said second center panel is separated from said second center panel by a fold line.

2. The pair of blanks of claim 1, further comprising, a first and a third of said first blank four flap panels having an elongated slot, said first and said third flap panels being on opposite side of said first center panel, and wherein each elongated slots is parallel to the other elongated slot, and wherein said first blank center panel central fold line is parallel to said elongated slots.

3. The pair of blanks of claim 1, further comprising said second blank flap panels having a peripheral edge that longer than half the distance between said central fold line and a parallel center panel edge fold line, said peripheral edge being an edge not parallel with said central fold line.

4. The method of forming and filing a package, said package comprising the pair of blanks of claim 1, further comprising said first blank first flap panel having a peripheral edge and said third flap panel having a peripheral edge and comprising the steps of:

a—rotating said first blank first and second flap panels about their fold lines, from the plane of said first blank toward a position in which said first blank first flap panel peripheral edge and said second flap panel peripheral edge are separated by a distance equal to or less that the distance between the first flap panel fold line and the second flap fold line, b—securing a support film member to said first blank first and third flap panels, said support film member being positioned and dimensioned to be taut when said box is in a rectangular or square cross-sectional configuration and flaccid when said box is in a hexagonal cross-sectional configuration, c—fixing said second blank first flap panel to said first blank first flap panel, d—fixing a second blank second flap panel to a first blank second flap panel, said second blank second flap panel having its fold line parallel to said first blank first central fold line, said second blank having a central fold line extending parallel to said first blank central fold line when said first blank and said second blank are in their assembled configuration and thereby forming a box, e— f—folding at least one flap panel about its fold line with a center panel to a position superadjacent a central panel, g—conforming said box to a hexagonal cross-section.

5. The method of claim 4, wherein said support film member is a pouch, and comprising the step of inserting a product into said pouch while said box is in a form having a hexagonal cross-section.

6. The method of claim 4, further comprising supporting said box in its hexagonal cross-sectional configuration on a substantially horizontal planar surface and positioning said box with its first blank center panel central fold line substantially vertical relative to said substantially horizontal planar surface, and inserting an article into said box for support by said support film member while said support film member is flaccid.

7. The method of claim 4, wherein the step of securing a support film to said first blank first and third flap panels further comprises wrapping a first end of a first support film around a peripheral edge of said first blank first flap panels and a second end of said first support film around another peripheral edge of said first blank third flap panel.

8. A box for retaining fragile products for shipping, comprising, a first center panel and four flap panels, each of said four flap panels being contiguous with an edge of said first center panel, and separated therefrom by a flap panel fold line, a first and a second of said four flap panels being on opposing sides of said first center panel, said first center panel having a central fold line extending parallel to two of said flap panel fold lines, and extending from said edge of said first center panel to an outer edge of at least one of said flap panels, a second center panel, said second center panel being contiguous with, and separated by a fold line from four flap panels, a second blank, said second blank having a center panel having a second central fold line extending parallel to said first central fold line, said second central fold line extending from an edge of said center panel to an outer edge of at least one of its contiguous flap panels, said box having a hexagonal configuration, at least one contiguous flap panel being folded about its fold line to a position superadjacent its contiguous central panel, and causing said box to conforming to a hexagonal cross-section, and support film means having two ends secured to panels contiguous with said first center panel along a line that is parallel to said center panel central fold line, and being positioned and dimensioned to be taut when said box is in a rectangular or square cross-sectional configuration and flaccid when said box is in a hexagonal configuration.

9. The box of claim 8, further comprising, a first and a second of said four flap panels having an elongated slot, said first and said second flap panels being on opposite side of said first center panel, and wherein each elongated slots is parallel to the other elongated slot and to said first center panel and said second central fold line.

10. The box of claim 8, further comprising an elongated slot in each of two panels that are contiguous with said first central panel, and wherein at least one end of said support film passes through an elongated slot from the interior side of a first of the two panels that is contiguous with the central panel to the exterior side of said central panel, and is secured to said exterior side of the first of the two panels that is contiguous with said central panel.

11. The box of claim 8, wherein said support film means is a pouch, and said elongated slots being substantially midway between the edges of the panel to which it is attached.

12. The box of claim 8, wherein said support film means is a pouch.

13. The box of claim 8, further comprising said support film being secured to said panels at a position proximate one of said center panels for supporting an article between said support film and said center panel.

14. The method of forming and filing a package, said package comprising at least one blank means having a first blank center panel, said first blank center panel having a first central fold line extending parallel to two of said flap panel fold lines, and extending from a center panel edge to an outer edge of at least one of its contiguous flap panels, a first and a second of said four flap panels being on opposing sides of said first center panel, a second center panel, said second center panel being contiguous with a flap panel at each of its four edges, and separated therefrom by an edge fold line, at least one of said flap panels having a pair of opposing end flaps contiguous therewith and separated therefrom by a fold line, said second central fold line extending parallel to said first central fold line and extending from an edge of said center panel to an outer edge of at least one of its contiguous flap panels, and wherein said pair of opposing end flaps are each separated from a neighboring flap panel by a slot, and wherein each contiguous end flap and flap panel is separated by a fold line, and each flap panel is separated from said second center panel by a fold line and comprising the steps of:

a—rotating first two flap panels contiguous with said first central panel about their fold lines, from the plane of said first central panel toward a position in which said two flap panels contiguous with said first central panel are separated by a distance equal to or less that the distance between the two flap panel fold lines with said first central panel, b—securing a support film to said first two flap panels, c—fixing a flap panel contiguous with said second central panel to one of said first two flap panels having said support film secured thereto, and forming a box, d—conforming said box to a hexagonal cross-section, e—supporting said box in its hexagonal cross-sectional configuration on a substantially horizontal planar surface and positioning said box with its first blank center panel central fold line substantially vertical relative to said substantially horizontal planar surface, and inserting an article into said box for support by said support film member while said support film member is flaccid.

15. The method of claim 14, wherein said support film means is a pouch, and inserting an article into said box for support by said support film member while said support film member is flaccid comprising inserting an article into said pouch.

* * * * *